United States Patent [19]

Yamamoto

[11] Patent Number: 4,462,596

[45] Date of Patent: Jul. 31, 1984

[54] PIECE-STACKING GAME DEVICE UTILIZING MAGNETIC FORCES

[76] Inventor: Shuzo Yamamoto, c/o Yasuyuki Yamamoto, 120 Ohaota, Kashiwashi, Chiba, Japan

[21] Appl. No.: 400,458

[22] Filed: Jul. 21, 1982

[30] Foreign Application Priority Data

Aug. 31, 1981 [JP] Japan ..... 56-128992[U]

[51] Int. Cl.[3] ..... A63F 3/00; A63F 9/14

[52] U.S. Cl. ..... 273/239; 273/290; 273/1 M; 446/129; 446/137

[58] Field of Search ..... 273/239, 241, 288, 287, 273/236, 1 M, 1 CB, 1 CM, 86 B, 290; 46/236, 237, 238, 84, 242

[56] References Cited

U.S. PATENT DOCUMENTS

| | | | |
|---|---|---|---|
| 3,045,393 | 7/1962 | Knott | 273/1 GM X |
| 3,082,004 | 3/1963 | Friedman | 273/239 |
| 3,550,943 | 12/1970 | Hatcher | 273/260 |
| 3,556,526 | 1/1971 | Currie | 273/239 |
| 3,625,514 | 12/1971 | Haaland | 273/95 R |
| 3,630,525 | 12/1971 | Weisbecker | 273/265 |
| 3,801,104 | 4/1974 | Potts et al. | 273/239 |
| 3,964,746 | 6/1976 | MacMurdo | 273/108 |
| 4,021,042 | 5/1977 | Sweeton | 273/239 |
| 4,233,777 | 11/1980 | Inoue | 46/238 |
| 4,328,970 | 5/1982 | Manno, Sr. | 273/239 |

FOREIGN PATENT DOCUMENTS

| | | | |
|---|---|---|---|
| 865376 | 3/1971 | Canada | 46/236 |

*Primary Examiner*—Richard C. Pinkham
*Assistant Examiner*—Scott L. Brown
*Attorney, Agent, or Firm*—Oldham, Oldham, Hudak, Weber & Sand Co.

[57] ABSTRACT

A plurality of magnetized game pieces are inserted one by one in a piece holder frame of nonmagnetic material along a piece guide formed therein. In the row of game pieces, two adjacent pieces are held in contact with or spaced apart from each other under magnetic attraction or repulsion acting therebetween and the row length is variable and unpredictable. The piece holder frame may be formed with any desired number of piece guides in the form of a blind piece-insertion hole or an upstanding post. The game pieces may be permanent bar magnets themselves or take a composite form including a body portion of nonmagnetic material and one or more magnet pieces embedded in the body portion of each and thereof. To make the game further changeful, the game pieces may each be divided into two axial half sections which are joined together for relative rotation to enable reversion of its polarity.

8 Claims, 18 Drawing Figures

PIECE-STACKING GAME DEVICE UTILIZING MAGNETIC FORCES

BACKGROUND AND SUMMARY OF THE INVENTION

This invention relates to piece-stacking game devices and more particularly to those of the type designed to utilize magnetic forces in stacking game pieces one on another.

According to the present invention, there is provided a piece-stacking game device which is characterized in that it comprises: a plurality of game pieces each having opposite magnetic poles formed at the opposite ends thereof; and a piece holder frame of nonmagnetic material formed with a piece guide structure along which the game pieces are to be stacked endwise one an another in a single row of variable length with two adjacent game pieces held in direct contact with or spaced apart from each other under magnetic attraction or repulsion acting between the opposed magnetic poles, respectively, of the two game pieces, the piece guide structure being so arranged that variation in length of the row of game pieces is externally readily perceptible. In use of the game device of the present invention, the game pieces are arranged by hand one by one in a row along the piece guide formed on the piece holder frame and, since any two adjacent guide pieces are held in direct contact with or spaced apart from each other under magnetic attraction or repulsion acting therebetween, the length of the row of game pieces is indefinite and variable even with the fixed number of game pieces arranged. Such indeterminacy of row length forms the basis of particular interest found in playing the game device. It is to be understood that the game pieces are all of the same make and symmetrical in appearance in relation to their midsection.

The foregoing and other objects and features of this invention will become more apparent by reference to the following description taken in conjunction with the accompanying drawings.

BRIEF DESCRIPTION OF THE DRAWINGS

In the drawings:

FIG. 1 is an oblique view of one of the game pieces used in the first embodiment;

FIG. 2 is a plan view of the piece holder frame of the first embodiment;

FIG. 3 is a front elevational view of same; and

FIG. 4 is a front elevation in cross section, illustrating the whole of the first embodiment in a state of use.

DESCRIPTION OF THE PREFERRED EMBODIMENTS

Figure 1:
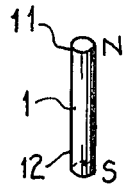
FIGS. 1 to 4 illustrate a first embodiment of the present invention.
Figure 2:
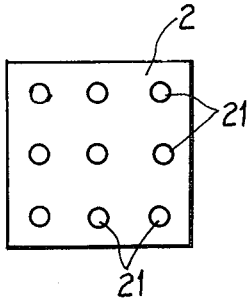
Figure 3:
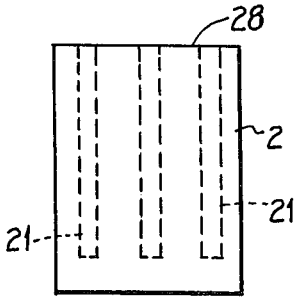

In FIGS. 1 to 4, there is illustrated a first embodiment of the present invention. As shown in FIG. 1, game pieces 1 employed in this embodiment are each a permanent bar magnet in the shape of right circular cylinder, having N and S poles formed at its axial ends 11 and 12. A plurality of such game pieces 1 and a piece holder frame 2 shown in FIGS. 2 and 3 are included in the game device of this embodiment. The piece holder frame 2 is a block made of a nonmagnetic material such as plastic, aluminum or wood in the shape of a rectangular prism and has a piece-guide structure including vertical blind insertion holes 21 formed in spaced parallel relation and each sized to slidable receive game pieces 1, which are inserted therein one by one by hand with either pole end 11 or 12 directed forward. The insertion holes 21 may be provided in any appropriate number, for example, nine as shown, and should each have a depth or axial length large enough to receive at least two game pieces 1.

Figure 4:
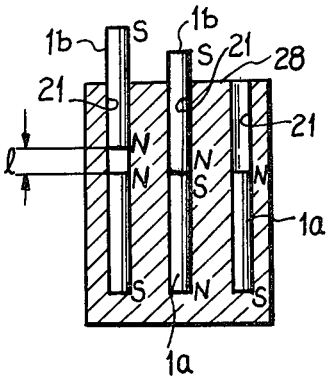

Description will next be made with reference to FIG. 4 of the manner in which the form of game device is used. First, game pieces 1 are inserted one into each of the piece-guide or insertion holes 21 formed in the piece holder frame 2, as indicated at 1*a;* and then a second game piece 1*b* is inserted into each of the insertion holes 21. Insertion of individual game pieces 1*a* and 1*b* can only be made at random with respect to their polarity since the opposite magnetic poles (N, S) on each of the game pieces 1 are indistinguishable by external appearance. Therefore, the length of the row of game pieces 1*a* and 1*b* in each of the insertion holes 21 is variable according to whether the neighboring ends of the two game pieces 1*a* and 1*b* are of the same or opposite polarity. As shown in FIG. 4, the neighboring ends of game pieces 1*a*, 1*b* in the left-hand side insertion hole 21 are of the same polarity (N, N) and held spaced apart from each other by a distance l under magnetic repulsion acting therebetween. In the middle insertion hole 21, however, the first and second game pieces 1*a*, 1*b* are held in direct contact with each other under magnetic attraction acting therebetween as the neighboring ends of these game pieces are of opposite polarity (S, N). Accordingly, in this case, the second game piece 1*b* in the left-hand side hole 21 extends upwardly beyond the top surface 28 of piece holder frame 2 to a greater extent than the one 1*b* in the middle hole 21. It will be appreciated that the game device can be enjoyed by scoring a point for each of the second game pieces 1*b* which protrude from the piece holder frame 2 in a greater amount. Incidentally, in FIG. 4, the righthand side hole 21 is shown in the state prior to insertion of a second game piece 1*b*.

Figure 5:
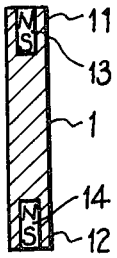
FIG. 5 is an axial cross section of one of the game pieces employed in a second embodiment of the present invention.

FIG. 5 illustrates one of the game pieces usable in a second embodiment of the present invention in combination with a piece holder frame principally the same as that 2 of the first embodiment. The game pieces 1 in this second embodiment each include a body portion formed of a nonmagnetic material, such as plastic, aluminum or wood, and a pair of aligned magnets 13 and 14 embedded in the body portion at the opposite ends 11 and 12 thereof. The magnet 13 embedded in one end 11 of the body portion is set with its N pole outwardly directed while the magnet 14 embedded in the other end 12 is set with its S pole outwardly directed so that the game piece 1 forms as a whole a bar magnet with an N pole at one end 11 and an S pole at the other end 12.

Figure 6:
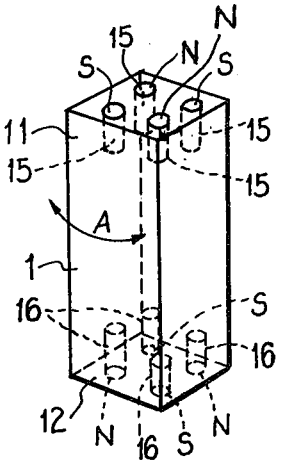
FIG. 6 is an enlarged oblique view illustrating one of the game pieces employed in a third embodiment of the invention.
Figure 7:
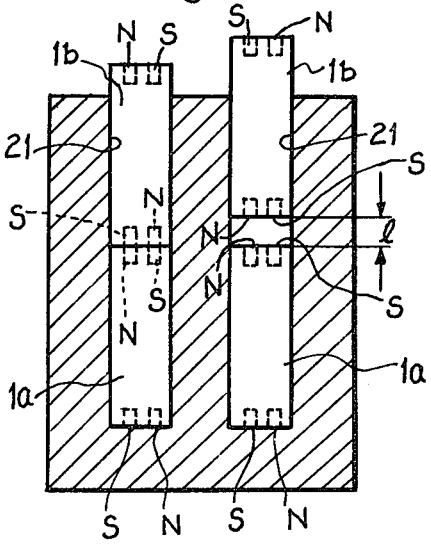
FIG. 7 is a front elevational view, in cross section, illustrating the third embodiment in a state of use.

FIGS. 6 and 7 illustrate a third embodiment of the present invention which includes a set of magnetized game piece 1 in the general shape of a rectangular prism, as shown in FIG. 6. The game pieces 1 each include a body portion formed of a nonmagnetic material, such as plastic, aluminum or wood, and an even number, say, four, of magnets 15 or 16 embedded in each end 11 or 12 of the body portion in equally spaced parallel relation with alternate N and S poles directed axially outwardly of the body portion. As illustrated, the magnets 15 are each axially aligned with one of the magnets 16 and, in each pair of aligned magnets 15 and 16, the outwardly directed poles of the respective magnets are opposite in polarity. In FIG. 7, a plurality of such game pieces 1 are shown inserted in each of piece-guide or insertion holes 21 formed in a piece holder frame 2 of non-magnetic material and each having a rectangular or square cross section corresponding to that of game pieces 1. As will be readily noted, this third embodiment can be played basically in quite the same manner as the first embodiment. If, in any of the insertion holes 21, the top end poles of upper magnets 15 or 16 in the first game piece 1*a* are opposite in polarity to the respective bottom end poles of lower magnets (16 or 15) in the second game piece 1*b*, the two game pieces 1*a* and 1*b* are held in direct contact with each other under magnetic attraction acting therebetween, as illustrated in the left-hand side hole 21 of FIG. 7. In contrast, if the opposing poles of the upper and lower magnets, respectively, of the first and second game pieces 1*a* and 1*b* are of the same polarity, as shown in the righthand side hole 21 of FIG. 7, the second game piece 1*b* is held spaced a distance l from the first one 1*a* under magnetic repulsion acting therebetween. In the third embodiment, it is to be noted that the magnetic interaction between the first and second game pieces 1*a* and 1*b* is reversed from attraction to repulsion or vice versa if the second game piece 1*b* is turned about its axis through an angle of 90 degrees, clockwise or counterclockwise, as indicated by the double arrow A in FIG. 6, prior to its insertion. This apparently means substantial increase in pleasure obtainable in playing such form of piece-stacking game device.

Figure 8:
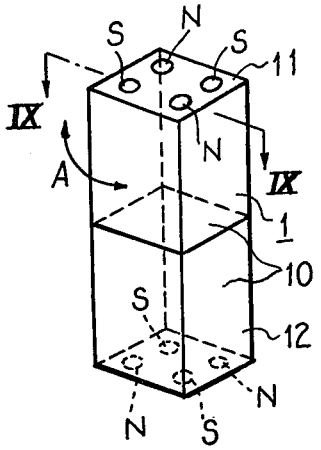
FIG. 8 is an oblique view showing one of the game pieces employed in a fourth embodiment of the present invention.
Figure 9:
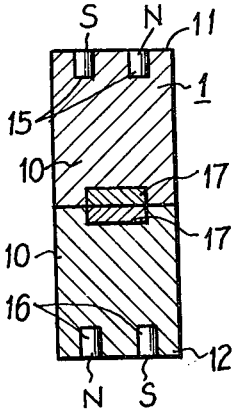
FIG. 9 is a vertical cross section of the game piece, taken along the line IX—IX in FIG. 8.
Figure 9A:
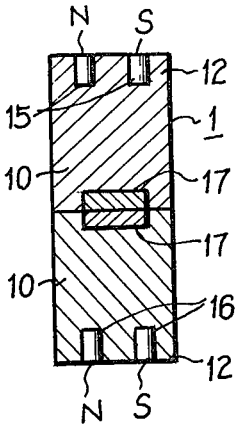
FIG. 9A is a cross-sectional view, similar to FIG. 9, illustrating a modification of the game piece shown therein.

FIGS. 8, 9 and 9A illustrate a fourth embodiment of the present invention, only showing the form of game piece usable therein, which is a modification of the form employed in the third embodiment. The game pieces 1 are each divided, as shown, into two axial half sections 10, which are joined together for rotation relative to each other by appropriate means, for example, including a pair of permanent magnets 17 embedded in the neighboring end faces of the two half sections 10, as illustrated in the cross-sectional view of FIG. 9, taken along the line IX—IX in FIG. 8. In FIG. 9 are also shown those magnets 15 and 16 embedded in the opposite ends 11 and 12 of the game piece 1 which lie in the cross-sectional plane IX—IX. Now, if the upper half section 10 of the game piece 1 in the state shown in FIG. 8 is turned by hand relative to the lower half section 10 through an angle of 90 degrees, clockwise or counterclockwise, as indicated by the double arrow A, the magnets 15 in the upper half section 10 are virtually reversed in polarity, being each replaced by one or the other of the two neighboring magnets 15, as illustrated in FIG. 9A, a cross section taken along the same line of section IX—IX indicated in FIG. 8. Thus, according to this embodiment, the game pieces 1 each have two different polarity states, giving a wider range of variability in use of the game device.

Figure 10:
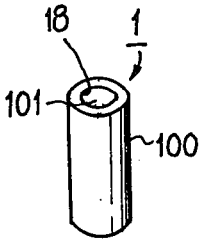
FIG. 10 is an oblique view showing one of the game pieces employed in a fifth embodiment of the present invention.
Figure 11:
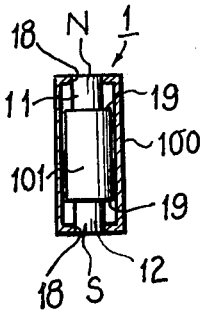
FIG. 11 is an axial cross section of the game piece shown in FIG. 10.
Figure 12:
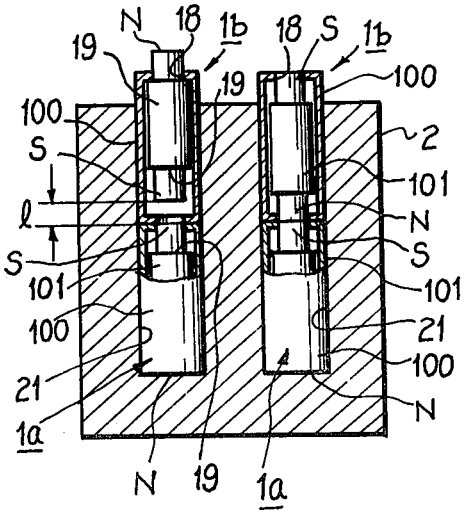
FIG. 12 is a front elevational view, in cross section, showing the fifth embodiment in a state of use.

Description will next be made of a fifth embodiment of the present invention, which is illustrated in FIGS. 10, 11 and 12. The game pieces 1 used in this embodiment are each formed of a hollow cylindrical shell 100 of nonmagnetic material and a solid cylindrical permanent magnet 101 slidably fitted therein. The hollow cylindrical shell 100 has opposite end walls with central apertures 18 formed therein. The magnet 101 is reduced in diameter at its opposite ends to define annular shoulders 19 thereon which are each engageable with the adjacent end wall of the cylindrical shell 100 to limit the range of axial sliding movement of the magnet 101 in the cylindrical shell 100. In use of this embodiment, a plurality of such game pieces 1 are inserted at random in each of insertion holes 21 formed in a piece holder frame 2, as with the cases of the embodiments previously described. In FIG. 12, the neighboring ends of first and second game pieces 1*a* and 1*b* inserted in the left-hand side hole 21 are of the same polarity (S, S) and, though their hollow cylindrical shells (100) are laid in close contact with each other, the magnet 101 of second game piece 1*b* is held raised at a distance l from the magnet 101 of first game piece 1*a* under magnetic repulsion acting therebetween, the upper annular shoulder 18 of magnet 101 of the second game piece 1*b* abutting against the inside surface of the top end wall of the cylindrical shell 100. In this manner, the upper reduced-diameter end portion, extending through the central aperture 18 in the adjacent end wall of cylindrical shell 100 of the second game piece 1*b*, protrudes upwardly therefrom the same distance l. Again in FIG. 12, the neighboring ends of the first and second game pieces 1*a*, 1*b* inserted in the right-hand side hole 21 are opposite in polarity (S, N) and not only the cylindrical shells 100 but also the magnets 101 of the two game pieces 1*a*, 1*b* are held in close contact with each other under magnetic attraction therebetween, the top end face of the magnet 101 of second game piece 1*b* being kept flush with the adjacent end face of cylindrical shell 100. With this embodiment, it will be readily recognized that whether the magnet 101 of the second game piece 1*b* is in the position raised to protrude upwardly from the adjacent end face of the associated cylindrical shell 100 or not can be readily determined by feeling the top end of the game piece 1*b* to ascertain the relative position of the cylindrical shell 100 and magnet 101, though the cylindrical shell 100 is invariably held in contact with that of first game piece 1*a*, and this makes the device suitable even for visually handicapped people or for use with blinders.

Figure 13:
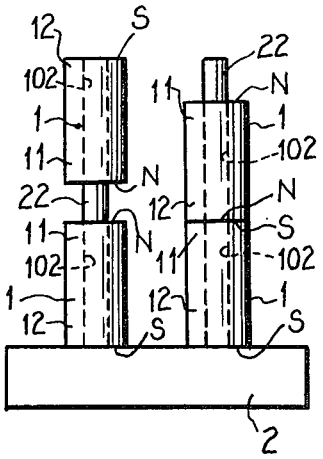
FIG. 13 is a front elevation of a sixth embodiment of the present invention.

FIG. 13 illustrates a sixth embodiment of the present invention, which includes a set of cylindricalshaped game pieces 1 each having an axial guide bore 102 extended therethrough and a piece holder frame 2 including an appropriate number of piece guides in the form of upstanding posts 22. As in the embodiments described hereinbefore, the game pieces 1 are magnetized, each having opposite magnetic poles at its ends 11 and 12. In use of this form of game device, a plurality of bored game pieces 1 are stacked one on another along each of upstanding guide posts 22 and the variability in height of the stacks makes the device particularly enjoyable, as with the cases of the embodiments previously described.

Figure 13A:
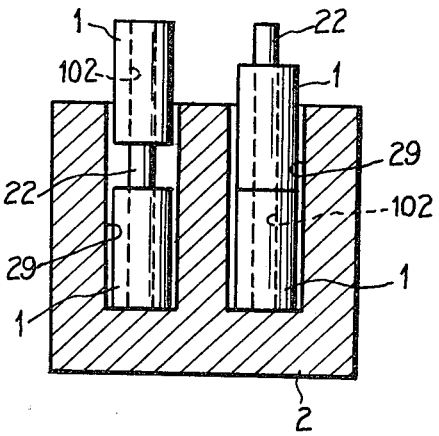
FIG. 13A is a front elevation, in cross section, ilustrating a modification of the sixth embodiment.

FIG. 13A illustrates a modification of the sixth embodiment of FIG. 13, which includes a piece holder frame 2 made larger in height than that in the FIG. 13 embodiment and recessed, as at 29, around each of the guide posts 22 in a diameter large enough to allow insertion of a definite number of bored game pieces 1 along the guide post 22. Obviously, with this structure, the game pieces 1 once inserted are practically kept out of sight. Otherwise, this modified form of game device is of quite the same structure as the embodiment of FIG. 13. It is to be noted that, in the forms of game device shown in FIGS. 13 and 13A, game pieces 1 may take any desired form and, for example, the game pieces 1 of FIG. 6 or 8 can also be employed provided that they are each formed additionally with an axial guide bore of rectangular cross section while at the same time the guide posts 22 are changed in cross-sectional shape from circular to rectangular.

Figure 14:
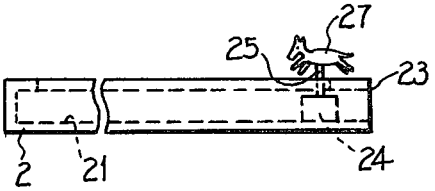
FIG. 14 is a front elevational view of a seventh embodiment of the present invention.
Figure 15:
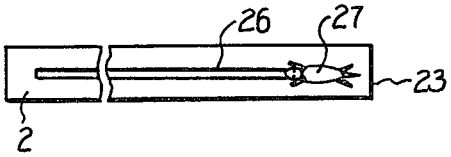
FIG. 15 is a plan view of same.
Figure 16:
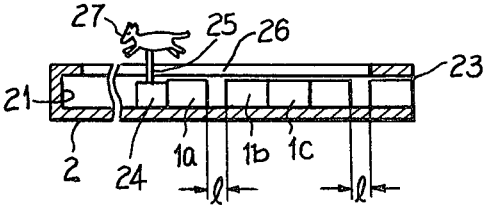
FIG. 16 is a front elevation, in cross section, showing the seventh embodiment in a state of use.

FIGS. 14, 15 and 16 illustrate a seventh embodiment of the present invention, which includes a piece holder frame 2 in the form of an elongated rectangular box of nonmagnetic material having a horizontal piece guide or insertion hole 21 is formed therein and a set of magnetized game pieces 1 to be inserted by hand one by one into the guide hole 21 at its open end 23. To externally indicate the position of the head game piece 1*a* of the row of game pieces 1*a*, 1*b*, 1*c*, . . . as inserted in the guide hole 21, an indicator piece 24 of nonmagnetic material is normally slidably fitted in the guide hole 21. Reference numeral 25 indicates an upright staff secured at its bottom to the top of indicator piece 24 and protruding upwardly through an elongated slot 2*b* formed in the top wall of insertion hole 21 lengthwise thereof. A flag piece 27, for example, horse-shaped, is fixed to the top end of staff 25. The game pieces 1 employed in this embodiment are permanent bar magnets preferably of rectangular cross-sectional shape.

In use of the embodiment shown in FIGS. 14 to 16, first the flag piece 27 is shifted by hand to its starting position neighboring the open end 23 of insertion hole 21, as shown in FIGS. 14 and 15. Then, the game pieces 1*a*, 1*b*, 1*c*, . . . are inserted by hand one by one into the insertion hole 21 so that the indicator piece 24, carrying flag-staff 25, is pushed progressively forward, i.e., to the left as viewed in FIGS. 14 to 16 by the head game piece 1*a*, which is in direct pressure contact with the indicator piece 24. In the row of game pieces 1 inserted, any two adjacent pieces are held in direct contact with or spaced apart a distance l from each other under magnetic attraction or repulsion acting therebetween according as their neighboring pole ends are opposite or the same in polarity. Therefore, even when a fixed number of game pieces 1 have been inserted, the final position of flag 27 is indefinite and variable. This form of game device can thus be played with much interest by competing either in total distance of travel of the flag 27 or in number of game pieces 1 required to drive the flag 27 to its extreme end position.

It will be readily noted that in the present invention the game pieces 1 may have a hexagonal or other desired cross-sectional shape different from those shown in the embodiments described and also be colored, if desired, to facilitate recognition of their position when inserted in the piece holder frame 2. It will also be noted that the shape of piece holder frame 2 and the number and arrangement of piece guides formed therein can be determined freely as desired.

Incidentally, in the drawings, the same references have been used for similar parts which have the same functions, throughout the figures illustrating several embodiments of the present invention.

To summarize, the piece-stacking game device of the invention, which utilizes magnetic forces, is played by arranging a plurality of game pieces on a piece holder frame 2 along a piece guide structure 21 (22) formed therein and is enjoyable on the variability of the length of the row of game pieces so arranged. Such game device allows changeful plays despite of simple hand operation needed and is highly versatile, being usable not only for games competing for points but for encamping games and fortune-telling. It can also be used for gobang playing, with protruding and non-protruding game pieces on the piece holder frame representing "go" stones played by two opponent players, respectively.

What is claimed is:

1. A piece-stacking game device characterized in that it comprises: a plurality of rod-shaped game pieces (1) each having opposite magnetic poles formed at the opposite ends (11,12) thereof; and a piece holder frame (2) of nonmagnetic material formed with a piece guide structure along which said game pieces (1) are to be stacked endwise one on another in a single row of variable length with two adjacent game pieces (1) held in direct contact with or spaced apart from each other under magnetic attraction or repulsion acting between the opposed magnetic poles, respectively, of the two game pieces, said piece guide structure being so arranged that variation in length of said row of game pieces (1) is externally readily perceptible; and said piece guide structure including at least one blind insertion hole (21) formed in said piece holder frame (2) and sized to slidably receive at least two of said game pieces (1).

2. A piece-stacking game device as claimed in claim 1, further characterized in that said game pieces (1) are each formed therethrough with an axially extending guide bore (102), said piece guide structure including at least one upstanding guide post (21) formed on said piece holder frame (2) and over which post at least two of said pieces (1) can be slidably fitted.

3. A piece-stacking game device as claimed in claim 1, further characterized in that said game pieces (1) are each in the form of a single permanent bar magnet.

4. A piece-stacking game device characterized in that it comprises: a plurality of rod-shaped game pieces (1) each having opposite magnetic poles formed at the opposite ends (11,12) thereof; and a piece holder frame (2) of nonmagnetic material formed with a piece guide structure along which said game pieces (1) are to be stacked endwise one on another in a single row of variable length with two adjacent game pieces (1) held in direct contact with or spaced apart from each other under magnetic attraction or repulsion acting between the opposed magnetic poles, respectively, of the two game pieces, said piece guide structure being so arranged that variation in length of said row of game pieces (1) is externally readily perceptible; and said game pieces (1) each being composed of a body portion formed of a nonmagnetic material and a pair of permanent mangets (13,14) embedded in said body portion at the opposite ends thereof in axially aligned relation and so directed that the outer magnetic poles of said respective permanent magnets are opposite in polarity to each other.

5. A piece-stacking game device as claimed in claim 4, further characterized in that said game pieces (1) are each composed of a body portion of rectangular cross section formed of a nonmagnetic material and an even number of permanent magnets (15 or 16) embedded in said body portion at each end thereof in equally spaced relation about the axis of said body portion and having alternately N and S poles directed axially outwardly of said body portion.

6. A piece-stacking game device as claimed in claim 5, further characterized in that said body portion of each of said game pieces (1) is composed of two half-length sections (10) joined together by appropriate joint means for angular displacement relative to each other.

7. A piece-stacking game device characterized in that it comprises: a plurality of rod-shaped game pieces (1) each having opposite magnetic poles formed at the opposed ends (11,12) thereof; and a piece holder frame (2) of nonmagnetic material formed with a piece guide structure along which said game pieces (1) are to be stacked endwise one on another in a single row of variable length with two adjacent game pieces (1) held in direct contact with or spaced apart from each other under magnetic attraction or repulsion acting between the opposed magnetic poles, respectively, of the two game pieces, said piece guide structure being so arranged that variation in length of said row of game pieces (1) is externally readily perceptible; and said game pieces each being composed of a hollow cylindrical shell (100) of nonmagnetic material having opposite end walls each formed with a central aperture (18) and a permanent magnet (101) slidably fitted in said hollow cylindrical shell (100) and reduced in diameter at the opposite ends to define a pair of spaced-apart annular shoulders (19) for abutting engagement with the opposite end walls of said hollow cylindrical shell (100), said control aperture (18) in each of the shell end walls receiving the adjacent reduced-diameter end portion of said permanent magnet (101).

8. A piece-stacking game device characterized in that it comprises: a plurality of rod-shaped game pieces (1) each having opposite magnetic poles formed at the opposite ends (11,12) thereof; and a piece holder frame (2) of nonmagnetic material formed with a piece guide structure along which said game pieces (1) are to be placed endwise one adjacent another in a single row of variable length with two adjacent game pieces (1) held in direct contact with or spaced apart from each other under magnetic attraction or repulsion acting between the opposed magnetic poles, respectively, of the two game pieces, said piece guide structure being so arranged that variation in length of said row of game pieces (1) is externally readily perceptible; and said piece holder frame (2) including a piece guide structure in the form of a horizontally extending blind insertion hole (21) and an elongated slot (2*b*) formed in parallel to said insertion hole (21) through the top wall thereof, said device further comprising an indicator piece (24) slidably fitted in said insertion hole (21), a flagstaff (25) fixed at the bottom to said indicator piece (24) and extending upwardly through said elongated slot (26), and a flag piece (27) secured to the top end of said flagstaff (25), the arrangement being such that, as said game pieces (1) are inserted into said insertion hole (21) one by one, said indicator piece (24) is pushed forward progressively by the first-inserted game piece (1*a*), said flag piece (27) continuously indicating the position of the first-inserted game piece (1*a*).

* * * * *